US006702251B2

(12) United States Patent
Iwata et al.

(10) Patent No.: US 6,702,251 B2
(45) Date of Patent: Mar. 9, 2004

(54) CONTROL VALVE IN VARIABLE DISPLACEMENT COMPRESSOR AND METHOD OF MANUFACTURING THE SAME

(75) Inventors: Kitaru Iwata, Kariya (JP); Naoya Yokomachi, Kariya (JP); Izuru Shimizu, Kariya (JP); Hirohito Hayashi, Kariya (JP); Hiroshi Fukasaku, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 186 days.

(21) Appl. No.: 10/083,987

(22) Filed: Feb. 25, 2002

(65) Prior Publication Data

US 2002/0117642 A1 Aug. 29, 2002

(30) Foreign Application Priority Data

Feb. 28, 2001 (JP) ..... 2001-054455

(51) Int. Cl.[7] ..... F16K 31/06
(52) U.S. Cl. ..... 251/129.18; 251/330
(58) Field of Search ..... 251/129.01–129.22, 251/318–334

(56) References Cited

U.S. PATENT DOCUMENTS 4,681,143 A * 7/1987 Sato et al. ..... 251/129.21
4,779,762 A * 10/1988 Klein et al. ..... 222/52
4,875,832 A * 10/1989 Suzuki et al. ..... 251/129.17
5,115,783 A * 5/1992 Nakamura et al. ..... 123/496
5,794,860 A * 8/1998 Neumann ..... 251/129.21

FOREIGN PATENT DOCUMENTS

JP 2000-028024 1/2000 ..... F16K/31/06

* cited by examiner

*Primary Examiner*—Paul J. Hirsch
(74) *Attorney, Agent, or Firm*—Morgan & Finnegan, LLP

(57) ABSTRACT

A control valve for a variable displacement compressor is provided. A retainer cylinder in the control valve includes a first cylindrical member made of non-magnetic material and a second cylindrical member having a bottom portion made of magnetic material. A shim is intervened a bottom surface of a plunger and inner bottom surface of the second cylindrical member. The retainer cylinder has good magnetic permeability between a coil and the plunger, even though the wall of the cylinder thickens to improve the withstanding pressure to internal refrigerant pressure.

15 Claims, 3 Drawing Sheets

CONTROL VALVE IN VARIABLE DISPLACEMENT COMPRESSOR AND METHOD OF MANUFACTURING THE SAME

BACKGROUND OF THE INVENTION

The present invention relates to a displacement control valve controlling the discharge capacity of variable displacement compressors that are included in the refrigerant circuit of air conditioners.

A typical control valve incorporates a solenoid valve, which is externally controllable. FIG. 4 shows an example of an electromagnetic actuator portion 101 in the control valve. A retainer cylinder 102 having a bottom portion is disposed in the electromagnetic actuator portion 101. A stationary core 103 and a movable core (plunger) 104 are disposed in the retainer cylinder 102. A coil 105 is disposed at outside of the retainer cylinder 102. Electric current through the coil 105 generates electromagnetic force between stationary core 103 and movable core 104. The electromagnetic force is applied to the movable core 104 to slide along an inner cylindrical surface of the retainer cylinder 102. This movement is transmitted to a valve body (not shown in the drawing) through a rod 106. The displacement of valve body based on the movable core 104 serves to adjust the opening degree of the valve to control a discharge displacement of the compressor.

The discharge displacement is achieved by, for example, changing a pressure in a crank chamber in which a swash plate is disposed. To change the pressure in the crank chamber, the control valve regulates the degree of the opening in a pressurizing passage, which supplies a pressurized refrigerant gas from the discharge chamber to the crank chamber.

Recently, air conditioners utilizing carbon dioxide as a refrigerant gas has become generally used. In such system, the pressure of the refrigerant gas is much higher than that of a conventional CFC (chlorofluorocarbon) gas. Accordingly, in order to control the displacement of the compressor that deal with carbon dioxide, it is necessary to increase the withstanding pressure of the control valve as well as the compressor. For example, a cylindrical wall of the retainer cylinder 102 may be thick to resist the internal pressure.

However, the retainer cylinder 102 is made of non-magnetic material to prevent magnetic flux from leaking out between the stationary core 103 and the movable core 104. Therefore, if the wall of the retainer cylinder 102 is thickened to resist the high internal pressure sufficiently, it will be harder for the magnetic flux to go through between the coil 105 and the movable core 104.

SUMMARY OF THE INVENTION

Accordingly, an object of the present invention is to provide a control valve, especially control valve in variable displacement compressor, in which a magnetic flux can easily go through between a coil and movable core even if a wall of the retainer cylinder is thickened in order to increase its withstanding pressure.

Another objective of the present invention is a method of adjusting the tolerance of the movable extent in the control valve, which is caused during its manufacture.

To achieve the foregoing, the present invention provides a control valve for operating fluid flow that goes through the control valve. The control valve includes a retainer cylinder, a stationary core, a movable core, a shim, a coil and a valve body. The retainer cylinder includes a first cylindrical member made of non-magnetic material and a second cylindrical member made of magnetic material, the second cylindrical member having a bottom portion. The stationary core is disposed in the retainer cylinder. The movable core is disposed in the retainer cylinder, and located between the stationary core and the bottom portion of the second cylindrical member. The shim is made of non-magnetic material, and disposed in the retainer cylinder and located between the movable core and the bottom portion of second cylindrical member. The coil is disposed around the retainer cylinder. The valve body is movably linked with the movable core. The valve body is actuated by a movement of the movable core in an elongated direction of the retainer cylinder. The movement of the movable core is based on an electromagnetic force that is generated between the stationary core and the movable core in accordance with an electric current supplied to the coil.

The control valve is appropriate for a variable displacement compressor that adjusts the discharge displacement in accordance with the inclination of a drive plate located in a crank chamber.

Also, the present invention provides a method of adjusting the amount of movable extent of a movable core in a control valve for operating fluid flow that goes through the control valve including a step of adjusting a thickness of the shim so that the amount of movable extent of the movable core in the retainer cylinder is adjusted.

Regarding the description of the invention, the term of "bottom" refers to a relative location with respect to the other structural elements described below, and is illustrated, by way of example, in FIG. 2. Therefore, if the control valve of the invention is installed in practical use "upside down" with respect to the orientation depicted in FIGS. 1–3, the term "bottom" should mean the reverse as

BRIEF DESCRIPTION OF THE DRAWINGS

The invention, together with objects and advantages thereof, may best be understood by reference to the following description of the presently preferred embodiments together with the accompanying drawing in which.

DETAILED DESCRIPTION OF THE PREFERRED EMBODIMENTS

A control valve for a variable displacement compressor according to an embodiment of the present invention will now be described.

Figure 1:
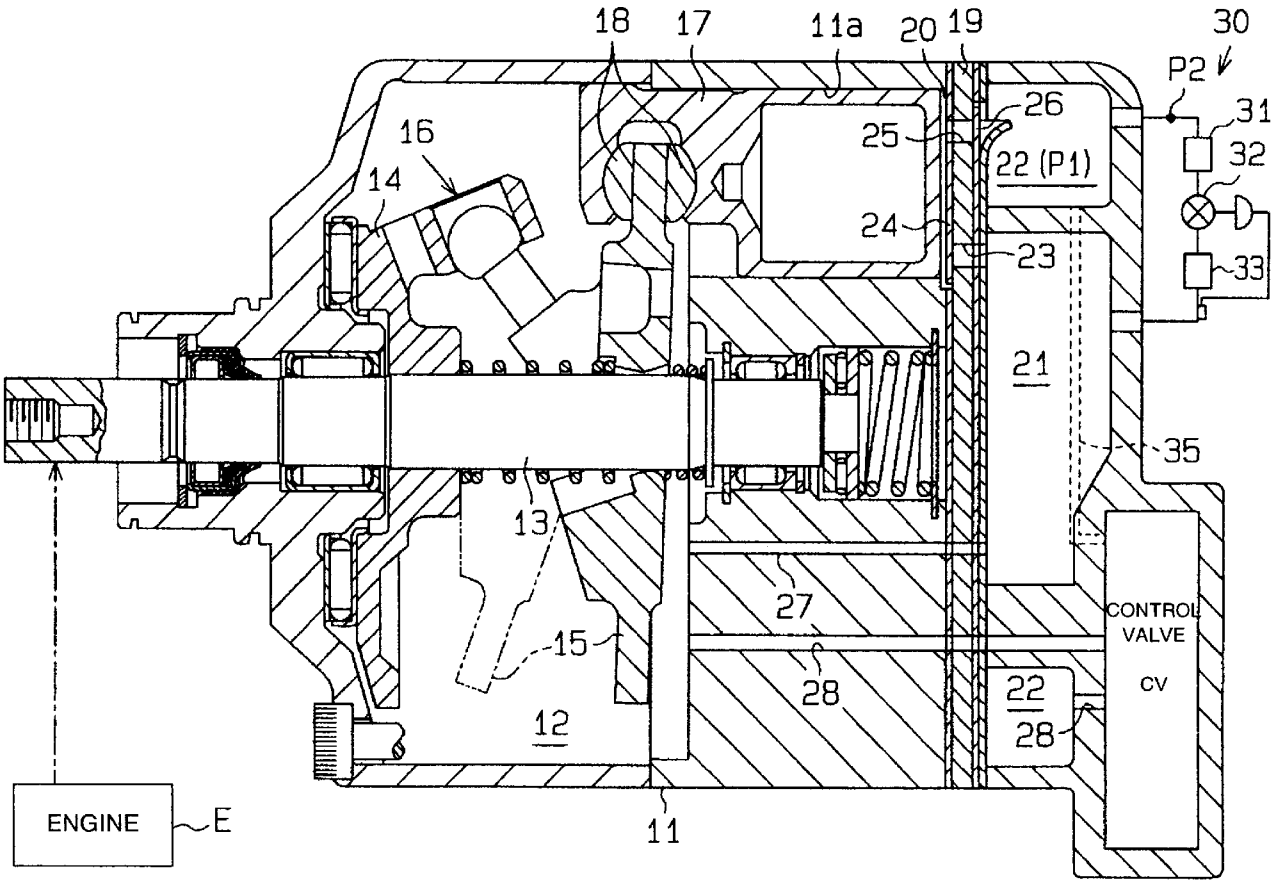
FIG. 1 is a cross-sectional view of a variable displacement type of swash plate compressor according to one embodiment of the present invention.

As shown in FIG. 1, a housing 11 of a variable displacement type swash plate compressor (hereinafter, compressor) defines a crank chamber 12 by an inner wall of the housing 11. A drive shaft 13 is rotatably supported in the housing 11. The drive shaft 13 is connected to an engine E as a power source of a vehicle, so that the engine E rotatably drives the drive shaft 13.

In the crank chamber 12, a lug plate 14 is fixed to the drive shaft 13 in order to rotate integrally with drive shaft 13. A swash plate 15, which serves as a cam plate, is disposed in the crank chamber 12. The swash plate 15 is supported by the drive shaft 13, to be slidable along and inclinable with respect to the axis of drive shaft 13. A hinge mechanism 16 is intervened between the lug plate 14 and the swash plate 15. Accordingly, the hinge mechanism 16 enables the swash plate 15 to rotate integrally with drive shaft 13 and to vary its inclination with respect to the axis of the drive shaft 13.

Cylinder bores 11*a* are formed in the housing 11 (in FIG. 1, only one cylinder bore is shown). A single-headed piston 17 is accommodated in the each cylinder bore 11*a*. Each piston 17 is coupled to the periphery of the swash plate 15 through shoes 18. Rotation of the drive shaft 13 is converted into reciprocation of the pistons 17 through the lug plate 14, the hinge mechanism 16, the swash plate 15 and the shoes 18.

At a rear side of the cylinder bores 11*a* (right side of FIG. 1), compression chambers 20 are defined by pistons 17 and valve-port assembly 19 that is disposed in the housing 11. Suction ports 23, suction valves 24, discharge ports 25 and discharge valves 26 are formed in the valve-port assembly 19. At the rear side in the housing 11, a suction chamber 21, which is a suction pressure zone, and a discharge chamber 22, which is a discharge pressure zone, are individually formed.

The movement of each piston 17 from the top dead center to the bottom dead center draws refrigerant gas to the corresponding compression chamber 20 through the corresponding suction port 23 and suction valve 24 in the valve-port assembly 19. The movement of each piston 17 from the bottom dead center to the top dead center compresses refrigerant gas in the corresponding compression chamber 20 to a predetermined pressure and discharges the refrigerant gas to the discharge chamber 22 through the discharge port 25 and discharge valve 26.

The variable displacement mechanism will now be described.

As shown in FIG. 1, a bleed passage 27 and a pressurizing passage 28 are respectively disposed in the housing 11. The bleed passage 27 continuously connects the crank chamber 12 to the suction chamber 21. The pressurizing passage 28 connects the discharge chamber 22 to the crank chamber 12. A control valve CV is located in the pressurizing passage in the housing 11.

The control valve CV adjusts the degree of the valve opening in order to control the flow of the high-pressured refrigerant gas through the pressurizing passage 28 from the discharge chamber 22 to the crank chamber 12. The bleed passage 27 releases the refrigerant gas from the crank chamber 12 to the suction chamber 21. Therefore, the pressure in the crank chamber 12 is controlled by the balance of the rate of inflow and the rate of outflow of refrigerant gas in crank chamber 12. The pressure in the crank chamber 12 is applied to the front side of the piston, and the pressure in the compression chambers 20 is applied to piston heads, respectively. Accordingly, the variation of the pressure balance varies the inclination of the swash plate 15. This varies the stroke of the pistons 17 and the displacement as well.

For example, when the pressure in the crank chamber 12 decreases, the inclination of the swash plate 15 increases in order to increase the displacement of the compressor. Contrary, when the pressure in the crank chamber 12 increases, the inclination of the swash plate 15 decreases in order to decrease the displacement of the compressor.

A refrigerant circuit will be now described.

As shown in FIG. 1, the refrigerant circuit for the air conditioner of the vehicle comprises the compressor and an external refrigerant circuit 30. The external refrigerant circuit 30 includes a condenser 31, an expansion valve 32, and an evaporator 33. Carbon dioxide is provided as refrigerant gas in the refrigerant circuit 30.

Figure 2:
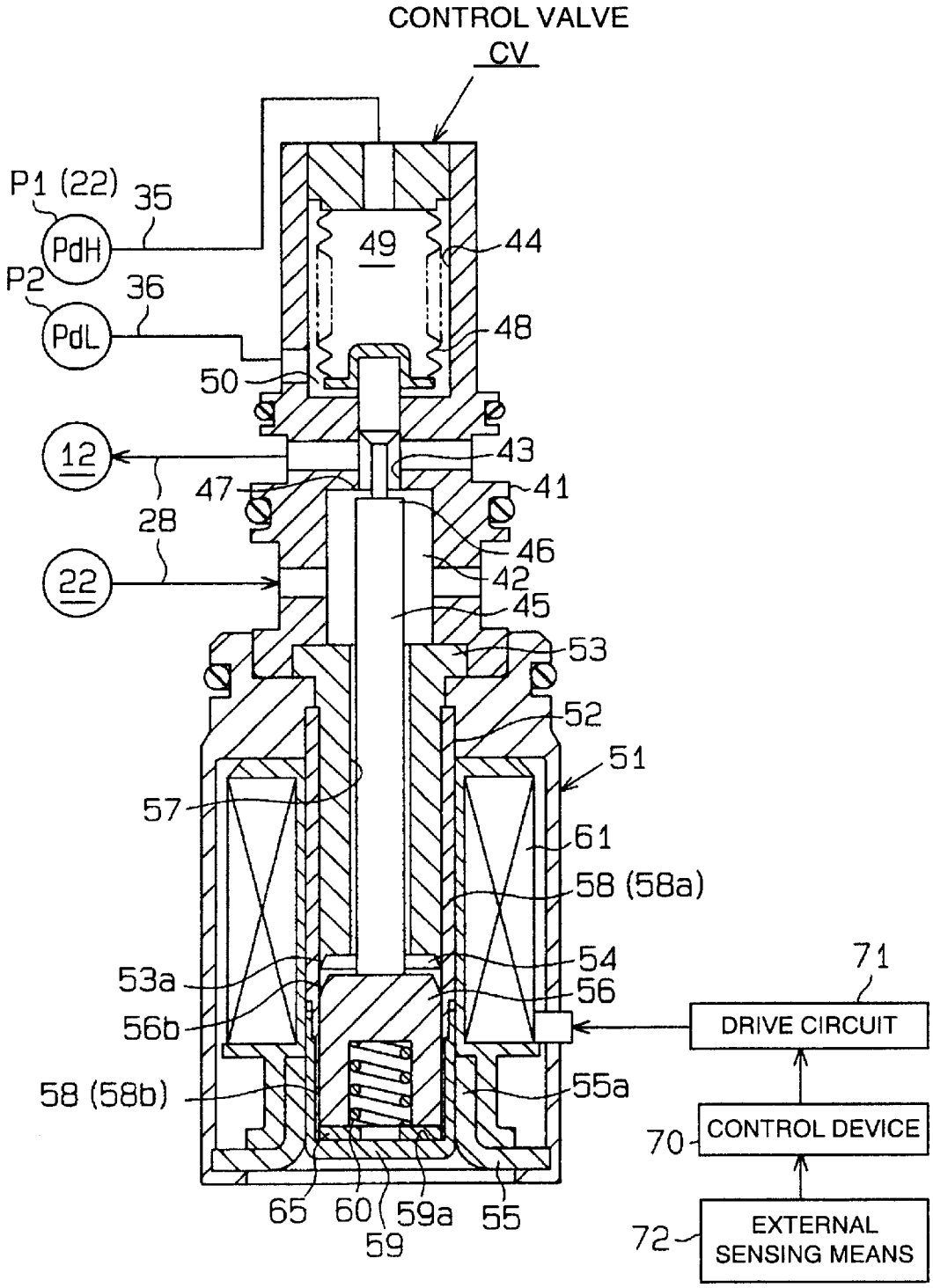
FIG. 2 is a cross-sectional view of a control valve.
Figure 4:
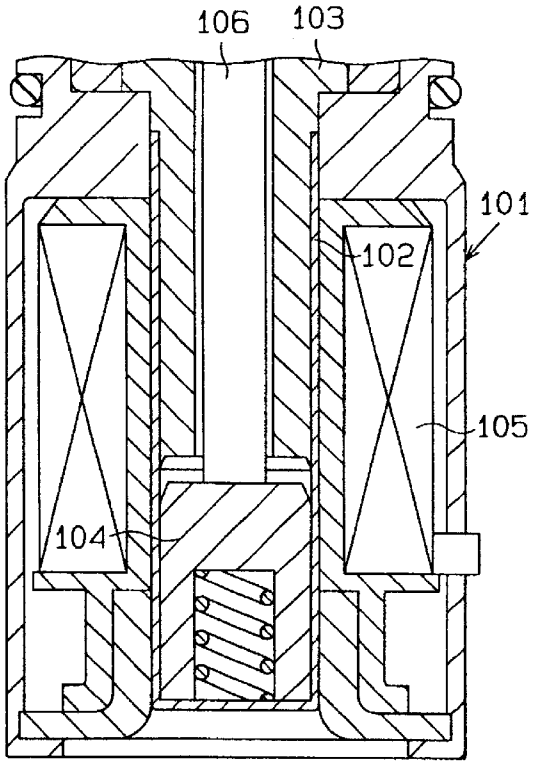
FIG. 4 (PRIOR ART)
FIG. 4 is an enlarged partial cross sectional view of a prior art control valve.

A first pressure detection point P1 is located in the discharge chamber 22. A second pressure detection point P2 is located in a refrigerant passage, which is predetermined distance downstream (the evaporator 31 side) from the first pressure detection point P1. As shown in FIG. 2, the first pressure detection point P1 is connected to the control valve CV through a first pressure introduction passage 35. The second pressure detection point P2 is connected to the control valve CV through a second pressure introduction passage 36.

The valve opening control and pressure detecting structure in the control valve will be now described.

As shown in FIG. 2, a valve housing 41 of the control valve CV defines a valve chamber 42, a communication passage 43 and a pressure sensing chamber 44. In the valve chamber 42 and the communication passage 43, a rod 45 is disposed for reciprocation in the axial direction (the vertical direction in FIG. 2). The communication passage 43 is isolated from the pressure sensing chamber 44 by the upper end portion of the rod 45 that blocks the upper communication passage 43. The valve chamber 42 is connected to the discharge chamber 22 through the upstream pressurizing passage 28. The communication passage 43 is connected to the crank chamber 12 through the downstream pressurizing passage 28. The valve chamber 42 and the communication passage 43 comprise a part of the pressurizing passage 28 as well.

A valve body portion 46, which is formed in the middle of rod 45, is disposed in the valve chamber 42. A step, which is located at a border between the valve chamber 42 and the communication passage 43, is formed as a valve seat 47. The communication passage 43 functions as a valve hole. Accordingly, the rod 45 is lifted up from the position as shown in FIG. 2 (bottom position) to a top position of which the valve body portion 46 is seated on the valve seat 47, then the communication passage 43 is shut down. Namely, the valve body portion 46 functions as a valve body to adjust the degree of the valve opening in the pressurizing passage 28.

A pressure sensing member 48 including a bellows is accommodated in the pressure sensing chamber 44. The top end of the pressure sensing member 48 is fixed on the valve housing 41. The bottom end of the pressure sensing member 48 is fitted on the top end of the rod 45. In the pressure sensing chamber 44, the pressure sensing member 48 divides into two separate chambers. One is a first pressure chamber 49 that is the inside of the pressure sensing member 48, and another is a second pressure chamber 50 that is the outside of the pressure sensing member 48 pressure PdH at the pressure detection point P1 is conducted into the first pressure chamber 49 through the first pressure introduction passage 35. A pressure PdL at the pressure detection point P2 is conducted into the second pressure chamber 50 through the second introduction passage 36.

An electromagnetic actuator portion 51 in the control valve will now described.

Figure 3:
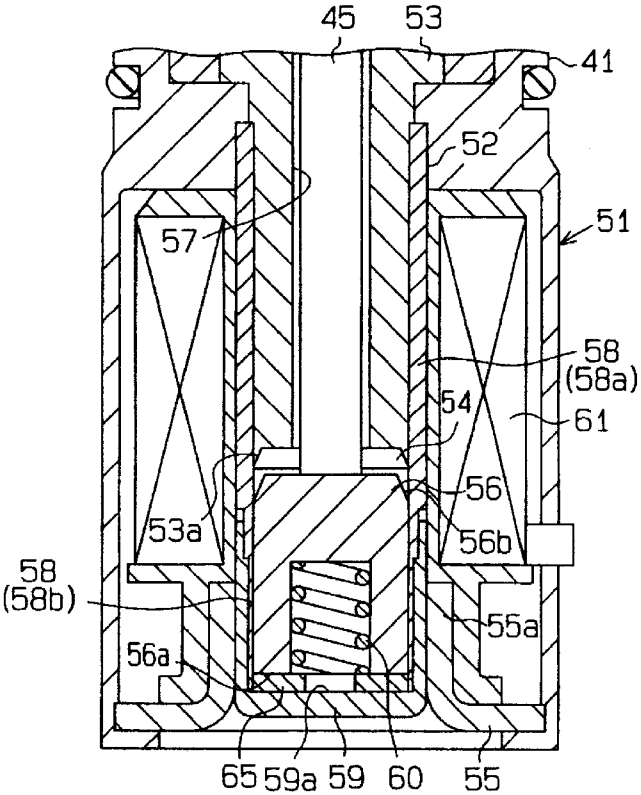
FIG. 3 is an enlarged partial cross-sectional view of the control valve of FIG. 2.

As shown in FIG. 3, the electromagnetic actuator portion 51 is located at the bottom of the valve housing 41. In the electromagnetic actuator portion 51, a retainer cylinder 52 having a bottom portion is disposed at the center portion of the valve housing 41. A center post 53, which serves as a stationary core, is made of magnetic material (such as alloy with an iron base), and fitted on the opening top of the retainer cylinder 52. A plunger chamber 54 is defined in the retainer cylinder 52 by fitting the center post 53 on the retainer cylinder 52. The center post 53, therefore, serves as a separator of the valve chamber 42 and the plunger chamber 54, as well.

A plate 55 is attached at a bottom-opening end in the valve housing 41. The plate 55 is formed in a ring-shape and is made of magnetic material. The inner circumference of the plate 55 is bent upward to form a cylindrical portion 55*a*. The plate 55 with the cylindrical portion 55*a* is fitted on the periphery of the retainer cylinder 52 so that the plate 55 block up an annular opening that exists between the bottom portion of the retainer cylinder 52 and the bottom of the valve housing 41.

A plunger 56, which serves as a movable core, is formed in a cylindrical shape and is made of magnetic material. The plunger 56 is accommodated in the plunger chamber 54 so that the plunger may move in the axial direction of the retainer cylinder 52. The movement of the plunger 56 is slidably guided by the inner surface of the retainer cylinder 52. A guide hole 57 is bored through the center of the center post 53. The bottom portion of the rod 45 is disposed in the guide hole 57 so that the rod 45 may move in the axial direction of the rod 45. The bottom end of the rod 45 contacts the top surface of the plunger 56 in the plunger chamber 54.

A projection portion 53*a* is annularly projected on the periphery of the bottom end of the center post 53 around the center axis of the valve housing 41. The projection portion 53*a* is downwardly tapered away to the plunger 56. A peripheral edge portion 56*b* is chamfered off from the edge of the plunger 56, in order to avoid the projection portion 53*a* and be faced along the inclined surface of the projection portion 53*a*. According to the structure, an electromagnetic attraction (See the following details), which is generated between the center post 53 and the plunger 56, has a linear characteristic with respect to the distance therebetween.

A spring 60 is accommodated between the bottom portion of the retainer cylinder 52 and the plunger 56 in the plunger chamber 54. The spring 60 urges the plunger toward the rod 45. The rod 45 is also urged by elastic character of the pressure sensing member 48 (hereinafter, a bellows spring 48) toward the plunger 56. Accordingly, the plunger 56 and the rod 45 are always moved up and down together. The urging elastic force of the bellows spring 48 is set to be greater than that of the spring 60.

The valve chamber 42 and the plunger chamber 54 are connected to each other through a space between the guide hole 57 and the rod 45. Therefore, the discharge pressure of the refrigerant gas is supplied into both the valve chamber 42 and the plunger chamber 54. It is generally known that a characteristic to control the valve is improved by supplying the same gas pressure into both the valve chamber 42 and the plunger chamber 54.

The retainer cylinder 52 includes a first cylindrical member 58, which is formed in a hollow shape and is made of non-magnetic material (such as non-magnetic stainless material), and a second cylindrical member 59 having a bottom portion, which is made of magnetic material. The entire second cylindrical member 59 including the side cylindrical portion as well as the bottom portion is made of non-magnetic material, in order to be easy to manufacture it.

The first cylindrical member 58 is disposed for surrounding the center post 53 and the plunger 56. The bottom-opening end of the first cylindrical member 58 is thinner than the other part (a large diameter portion 58*a*) and the bottom-opening end comprises a small diameter portion 58*b*. The second cylindrical member 59 is fitted with the outer surface of the small diameter portion 58*b* of the first cylindrical member 58. The outer cylindrical surface of the second cylindrical member 59 has almost the same diameter as the large diameter portion 58*a* of the first cylindrical member 58.

A shim 65 is located between a bottom surface 56*a* of the plunger 56 and an inner bottom surface 59*a* of the second cylindrical member 59 in the plunger chamber 54. The shim 65 is formed in a ring plate shape and is made of non-magnetic material. During the assembly of the control valve CV, a number of shims 65 having various thickness are provided so that the particular shim may be selected to correct an unevenness of the control valve CV. In the other words, providing the various thickness of the shims 65 is for adjusting the tolerance of movable extent of the plunger 56, even if the tolerance of each part or assembling each part in the control valve CV is added to increase the unevenness. The thickness of the shim 65 is greater than the thickness of the small diameter portion 58*b* of the first cylindrical member 58.

The inner circumference of the shim 65 is intervened between the inner bottom surface 59*a* and spring 60 so that the shim 65 serves as a spring seat as well. According to such structure, the spring 60 urges the shim 65 toward the inner bottom surface 59*a*. The shim 65 is, therefore, stably located in the plunger chamber 54 without fixing the shim 65 on the bottom surface of the plunger 56 or on the inner bottom surface 59*a* of the second cylindrical member 59. Further, regarding the present invention, the shim 65 may be fixed on the bottom surface of the plunger 56 or on the inner bottom surface 59*a* of the second cylindrical member 59.

A coil 61 is wound or disposed around the retainer cylinder 52 along a length thereof that surrounds portions of the center post 53 and the plunger 56. The coil 61 receives a electric current from a drive circuit 71 based on a signal from a control device 70 (such as computer) that receives external signals from an external sensing means 72, such as an On/Off signal of air-conditioner switch, an actual temperature in the passenger compartment, target temperature set by a adjuster, etc.

According to the electric current from the control device 70, magnetic flux is generated around the coil 61. The magnetic flux goes from the coil 61 through the plate 55 or the second cylindrical member 59 to the small diameter portion 58*b* of the first cylindrical member 58 and the plunger 56, and further, it goes through the plunger 56 to the center post 53. The electromagnetic force (electromagnetic attraction), which is corresponds to the amount of electric current flowing to the coil 61, is generated between the plunger 56 and the center post 53. This force is transmitted from the plunger to the rod 45. The electric current is controlled by an adjustment of the voltage to the coil 61. For the adjustment of the voltage, a PWM (pulse-width modulation) control is applied to the drive circuit 71.

An operating characteristic of the control valve CV will be now described. Regarding the illustrated control valve CV, the position of the rod 45 decides the valve opening degree of the valve body portion 46 as follows;

First, as shown in FIG. 2, the position of the rod 45 is determined by the downward force of the bellows spring 48 when no electric current is supplied to the coil 61 (duty of PWM=0%). Accordingly, the rod 45 is located at a bottom position in order to fully open the valve body portion 46 in the communication passage 43. The pressure in the crank chamber 12 is therefore to be a maximum under the condition. A differential pressure between the crank chamber 12 and the compression chamber 20 through the piston 17 is, therefore, a maximum under this condition. Consequently, the inclination angle of the swash plate 15 is at the maximum and the displacement of the compressor will be the minimum.

Next, when the current with a minimum duty (>0%) in the variable duty range is supplied to the coil 61, the electromagnetic force is generated and added upward to the urging force of the spring 60. When the added upward force exceeds the downward force of the bellows spring 48, the rod 45 moves upward. In this situation, the upward force, which comprises the electromagnetic force added to the urging force of the spring 60, is opposed by the downward force, which comprises the force resulting from the differential pressure ΔPd (=PdH–PdL) added to the downward force of the bellows spring 48. The valve body portion 46 with the rod 45 is positioned at the location where the forces applied to the rod 45 are equilibrated.

For example, if the amount of the refrigerant gas flow decreases based on a decrease of the engine E speed, the downward force of the differential pressure ΔPd decreases. Due to this change, the forces applied to the rod 45 lose their equilibrium. Accordingly, the rod 45 with the valve body portion 46 is lifted up to reduce the opening in the communication passage 43 so that the pressure in the crank chamber 12 decreases. The inclination angle of the swash plate 15 is increased to increase the displacement of the compressor. Consequently, the amount of the refrigerant gas flow in the refrigerant circuit 30 increases based on the larger displacement of the compressor, and the differential pressure ΔPd increases.

Contrary, if the amount of the refrigerant gas flow increases based on an increase of the engine E speed, the downward force resulting from the differential pressure ΔPd increases. Due to the change, the forces applied to the rod 45 lose their equilibrium. Accordingly, the rod 45 with the valve body portion 46 is lowered to enlarge the opening in the communication passage 43 so that the pressure in the crank chamber 12 increases. The inclination angle of the swash plate 15 is decreased to decrease the displacement of the compressor. Consequently, the amount of refrigerant gas flow in the refrigerant circuit 30 decreases based on the smaller displacement of the compressor, and the differential pressure ΔPd decreases.

Further to above, when the current duty to the coil 61 increases in order to increase the magnitude of the upward electromagnetic force, the forces applied to the rod 45 lose their equilibrium. Accordingly, the rod 45 with the valve body portion 46 is lifted up to reduce the opening in the communication passage 43 so that the displacement of the compressor increases. Consequently, the amount of refrigerant gas flow increases based on the larger displacement of the compressor, and the differential pressure ΔPd increases.

Contrary, when the current duty to the coil 61 decreases in order to decrease the magnitude of the upward electromagnetic force, the forces applied to the rod 45 lose their equilibrium. Accordingly, the rod 45 with the valve body portion 46 is lowered to enlarge the opening in the communication passage 43 so that the displacement of the compressor decreases. Consequently, the amount of refrigerant gas flow decreases based on the smaller displacement of the compressor, and the differential pressure ΔPd decreases.

In other words, the control valve CV has the structure that the rod 45 is automatically positioned based on the actual differential pressure ΔPd in order to maintain the differential pressure ΔPd at the control target (target differential pressure) that is determined by the electric current duty into the coil 61. The target differential pressure is externally variable by adjusting the current duty to the coil 61.

By the way, in the illustrated embodiment, the language of "bottom" describes the relative location with respect to the other structural elements the illustrated in FIG. 2. If the control valve or the compressor is installed in practical use upside down, the term "bottom" should mean the reverse as "top". The other words such as the "top", "up", "upward", "down" and "downward" should mean the reverse as well.

The illustrated embodiment has the following advantage.

(1) The retainer cylinder 52 includes the first cylindrical member 58 made of non-magnetic material and a second cylindrical member 59 having a bottom portion that is made of magnetic material. Accordingly, the magnetic permeability between the coil 61 and the plunger 56 is improved, even though the retainer cylinder 52 may be thickened to improve its withstanding pressure to the internal refrigerant gases such as the carbon dioxide.

(2) The shim 65, which is formed from non-magnetic material, is intervened between the bottom surface 56*a* of the plunger 56 and inner bottom surface 59*a* of the second cylindrical member 59. Therefore, the non-magnetic gap, which is formed by non-magnetic material of the shim 65, is secured between the magnetic material of the second cylindrical member 59 and the plunger 56, even though the plunger 56 is located at the lowest position. It enables to suppress the downward electromagnetic attraction between the bottom surface 56*a* of the plunger 56 and the inner bottom surface 59*a* of the second cylindrical member 59. Because the shim 65 is non-magnetic, there is a little downward electromagnetic attraction that would offset the upward electromagnetic force acting on the plunger 56 and the rod 45 from the coil 61. Furthermore, the upward electromagnetic force is conventionally controlled by the chamfered peripheral edge portion 56*b* of the plunger 56 in order to obtain the linear characteristic of the upward electromagnetic force to the distance between the center post 53 and the plunger 56. However, the downward electromagnetic attraction between the bottom surface 56*a* and the inner bottom surface 59*a* is extremely strong where the bottom surface 56*a* approaches the inner bottom surface 59*a*, on condition that there is no gap between them. According to the illustrated embodiment, the shim 65 secures the non-magnetic gap to suppress the downward electromagnetic attraction between the bottom surface 56*a* of the plunger 56 and the inner bottom surface 59*a* of the second cylindrical member 59. The external controllability of the control valve CV is, therefore, improved so that the control of the displacement of the compressor may be more accurate.

(3) The first cylindrical member 58 is disposed for directly surrounding the plunger 56, and the second cylindrical member 59 is disposed for surrounding the small diameter portion 58*b* of the first cylindrical member 58. During the operation, the plunger 56 is guided to slide on the inner cylindrical wall of the first cylindrical member 58 that is made of non-magnetic material. Generally, magnetic material tends not to slide well on other magnetic materials. Therefore, the illustrated embodiment has the advantage of the slidablity of the plunger 56 on the inner wall of the first cylindrical member 58. Further to above, the inner cylindrical wall of the first cylindrical member 58 covers the full extent of the plunger's range of movement in order to slidably guide the plunger 56. Accordingly, the sliding resistance between the plunger 56 and the retainer cylinder 52 is decreased. This structure suppresses the hysteresis characteristics, which appears in the degree of the control valve opening in accordance with the current duty rate into the coil 61.

(4) Regarding the first cylindrical member 58 made of non-magnetic material, the portion in the vicinity of the plunger 56 (small diameter portion 58*b*) is thinned. Therefore, the magnetic permeability between the coil 61 and plunger 56 is improved so that even a small coil 61 may generate sufficient electromagnetic force to actuate the plunger 56. This serves to miniaturize the electromagnetic actuator portion 51 as well as the control valve CV.

(5) The second cylindrical member 59 is fixed to the outer surface of the small diameter portion 58*b* of the first cylindrical member 58. The second cylindrical member 59 serves to reinforce the small diameter portion 58*b*. The retainer cylinder 52, therefore, maintains the strengths even though the wall of the first cylindrical member 58 is thinned. According to this structure, the withstanding pressure is improved so that the hi-pressured carbon dioxide may be applied as the refrigerant gas. As well, it is easier to introduce the hi-pressured discharge gas into the plunger chamber 54.

(6) The non-magnetic shim 65 serves as the adjustment member for adjusting the tolerance of the movable extent of the plunger 56. Accordingly, the illustrated method corrects the unevenness of the movable extent of the plunger 56 in connection with an unevenness of the valve opening control.

The present invention can further be embodied, for example, in;

a control valve that is not disposed in the pressurizing passage 28, but in the bleed passage 27 to control the pressure in the crank chamber 12. This type is generally called a bleeding control valve.

the other type of electromagnetic control valves, such as the valve is operated by only electromagnetic power without any pressure sensing mechanism (pressure sensing member 48).

a control valve for controlling a wobble type compressor.

Therefore, the present examples and embodiments are to be considered as illustrative and not restrictive and the invention is not to be limited to the details given herein but may be modified within the scope of the appended claims.

What is claimed is:

1. A control valve for operating fluid flow that goes through the control valve, the control valve comprising;

a retainer cylinder including a first cylindrical member made of non-magnetic material and a second cylindrical member made of magnetic material, the second cylindrical member having a bottom portion;

a stationary core disposed in the retainer cylinder;

a movable core disposed in the retainer cylinder, wherein the movable core is located between the stationary core and the bottom portion of the second cylindrical member;

a shim made of non-magnetic material, the shim is disposed in the retainer cylinder and located between the movable core and the bottom portion of the second cylindrical member, a coil disposed around the retainer cylinder; and a valve body movably linked with the movable core, wherein the valve body adjusts a degree of a valve opening based on a movement of the movable core in the retainer cylinder, and wherein the movement of the movable core is based on an electromagnetic force that is generated between the stationary core and the movable core in accordance with an electric current supplied to the coil.

2. The control valve according to claim 1, wherein an inner wall of the first cylindrical member surrounds the movable core so that the inner wall contacts to a surface of the movable core.

3. The control valve according to claim 2, wherein the first cylindrical member having a small diameter portion, and the second cylindrical member is fitted with an outer surface of the small diameter portion.

4. The control valve according to claim 1, further comprising a spring urges the movable core to the bottom portion of the second cylindrical member, wherein the valve body is positioned at where the electromagnetic force and an urging force of the spring are equilibrated.

5. A control valve in a variable displacement compressor that adjust a discharge displacement in accordance with the inclination angle of a swash plate disposed in a crank chamber, wherein the inclination angle of the swash plate varies according to the differential pressure between a pressure in the crank chamber and the pressure in a cylinder bore, wherein the compressor includes a adjusting device for adjusting the differential pressure, wherein the adjusting device includes the control valve and a gas passage for conducting refrigerant gas, and wherein the control valve regulates the amount of the refrigerant gas flow in the gas passage, the control valve comprising:

a retainer cylinder including a first cylindrical member made of non-magnetic material and a second cylindrical member made of magnetic material, the second cylindrical member having a bottom portion;

a stationary core disposed in the retainer cylinder;

a movable core disposed in the retainer cylinder, wherein the movable core is located between the stationary core and the bottom portion of the second cylindrical member;

a shim made of non-magnetic material, the shim is disposed in the retainer cylinder and located between the movable core and the bottom portion of the second cylindrical member, a coil disposed around the retainer cylinder; and a valve body movably linked with the movable core, wherein the valve body adjusts a degree of a valve opening based on a movement of the movable core in the retainer cylinder, and wherein the movement of the movable core is based on an electromagnetic force that is generated between the stationary core and the movable core in accordance with an electric current supplied to the coil.

6. The control valve according to claim 5, wherein an inner wall of the first cylindrical member surrounds the movable core so that the inner wall contacts to a surface of the movable core.

7. The control valve according to claim 6, wherein the first cylindrical member having a small diameter portion, and the second cylindrical member is fitted with an outer surface of the small diameter portion.

8. The control valve according to claim 5, wherein the variable displacement compressor comprises a part of refrigerant circuit of an air conditioner, further including a pressure detection part in the refrigerant circuit, and a pressure sensing mechanism sensing a detected pressure of the pressure detection part, wherein the pressure sensing mechanism operates the valve body for controlling the variable displacement to reduce or cancel a fluctuation of the detected pressure.

9. The control valve according to claim 8, wherein the air conditioner further comprising a control device for controlling the electric current to the coil to adjust a target pressure in accordance to set a position of the valve body.

10. The control valve according to claim 9 further comprising a spring urges the movable core, wherein the valve body is positioned based on the electromagnetic force, the operation of the pressure sensing mechanism and the spring.

11. The control valve according to claim 9, wherein the pressure detection part provides two separate detection points in the refrigerant circuit, the pressure sensing mechanism operates based on a differential pressure between the two detection points, and the target pressure as a reference point of the valve body is variable by varying the electric current to the coil.

12. The control valve according to claim 11, where the two separate points of the pressure detection part are provided in a discharge pressure region of the refrigerant circuit.

13. The control valve according to claim 5, wherein the refrigerant gas is carbon dioxide.

14. A method of adjusting the amount of movable extent of a movable core in a control valve operating fluid flow that goes through the control valve, the control valve having, a retainer cylinder including a first cylindrical member made of non-magnetic material and a second cylindrical member made of magnetic material, the second cylindrical member having a bottom portion, a stationary core disposed in the retainer cylinder, a movable core disposed in the retainer cylinder, wherein the movable core is located between the stationary core and the bottom portion of the second cylindrical member, a shim made of non-magnetic material, the shim is disposed in the retainer cylinder and located between the movable core and the bottom portion of the second cylindrical member, a coil disposed around the retainer cylinder, and a valve body movably linked with the movable core, wherein the valve body adjusts a degree of a valve opening based on a movement of the movable core in the retainer cylinder, wherein the movement of the movable core is based on an electromagnetic force in accordance with an electric current supplied to the coil, the method comprising:

adjusting a thickness of the shim so that the amount of movable extent of the movable core in the retainer cylinder is adjusted.

15. The method according to claim 14, further comprising providing plural shims having various thickness, and selecting a particular shim having a particular thickness in the plural shims to correct manufacturing tolerance of the movable extent of the movable core.

* * * * *

UNITED STATES PATENT AND TRADEMARK OFFICE

CERTIFICATE OF CORRECTION

PATENT NO. : 6,702,251 B2
DATED : March 9, 2004
INVENTOR(S) : Iwata et al.

It is certified that error appears in the above-identified patent and that said Letters Patent is hereby corrected as shown below:

Column 2,
Line 37, after the language "should mean the reverse as" insert -- top. --

Signed and Sealed this

Third Day of August, 2004

JON W. DUDAS
*Acting Director of the United States Patent and Trademark Office*